United States Patent [19]

Wolff

[11] Patent Number: 4,528,778

[45] Date of Patent: Jul. 16, 1985

[54] IMPLEMENT SHARPENING DEVICE

[76] Inventor: Lee S. Wolff, 134 W. Forest Dr., Spartanburg, S.C. 29301

[21] Appl. No.: 467,022

[22] Filed: Feb. 16, 1983

[51] Int. Cl.[3] ..... B24B 3/52

[52] U.S. Cl. ..... 51/91 BS; 51/92 BS; 51/224; 51/285; 76/82.2

[58] Field of Search ..... 51/218 R, 218 A, 219 R, 51/220, 224, 285, 92 BS, 91 BS; 76/82.2

[56] References Cited

U.S. PATENT DOCUMENTS 3,879,899 4/1975 Riber ..... 51/92 BS

*Primary Examiner*—Harold D. Whitehead

*Attorney, Agent, or Firm*—Dority & Manning

[57] ABSTRACT

An apparatus for holding a blade of an implement while sharpening an edge thereon with a rotating sharpening wheel. The blade is carried by a blade holder which is, in turn, supported on a vertically extending bracket. The angle that the blade holder is supported on the bracket can be readily adjustable. A pair of opposed vertically extending posts are provided on the bracket so that the entire holder can be rotated for presenting the edge of the blade to different directions of rotation of the sharpening wheel.

9 Claims, 3 Drawing Figures

IMPLEMENT SHARPENING DEVICE

BACKGROUND OF THE INVENTION

Heretofore, there have been many types of machines for sharpening blades on implements such as scissors, however, normally they are relatively complicated or are not readily useable for sharpening an edge on the blade and for reversing the position of the blade for buffing the same edge. The sharpening of the edge normally takes place with a grinding wheel moving in the direction away from the cutting edge. When buffing the edge of the implement after the sharpening has taken place, this normally occurs with the buffing wheel moving in a direction toward the cutting edge.

Typical shears and scissors sharpeners are disclosed in U.S. Pat. Nos. 3,755,971; 1,381,416; 2,179,725; 3,574,268; 1,955,366; 1,200,605, and 1,472,760.

SUMMARY OF THE INVENTION

This invention relates to an apparatus for holding a blade of an implement such as a pair of scissors while sharpening an edge thereon. The device includes a blade holder that is carried on an outer extremity of an arm arrangement which includes a plurality of links. The links are pivotably connected together permitting the blade holder to be moved horizontally in a straight line across the face of the sharpening wheel. The blade holder includes a support bracket which has an arcuate groove provided therein. A clamping jaw mechanism extends outwardly from the support bracket and positions the edge of the blade to be sharpened adjacent the surface of the sharpening wheel. A pair of posts extend laterally from the clamping jaw mechanism into the arcuate groove so that the angle of the clamping jaw can be adjusted by sliding the pair of posts within the groove. One of the posts is threaded for receiving a knob that can be drawn tightly adjacent the edge of the bracket for fixing the angle of the clamping jaw and, in turn, the blade relative to the sharpening wheel. The arcuate groove has a center of radius which is at approximately the edge of the blade being held by the clamping jaws. As a result of the manner in which the clamping jaws are attached to the support bracket through the posts extending into the arcuate groove, the blade can be positioned at substantially the same center point on the wheel whether it is set at a flat or an angle, for example, 55°.

The blade holder can be readily turned over so that the blade can be held adjacent a first grinding wheel with the direction of rotation of the grinding wheel being into the cutting edge being sharpened. When it is desired to put a fine edge or buff the edge of the blade with a buffing wheel, then the fixture with the blade therein is turned over so that the direction of rotation of the grinding wheel is toward the cutting edge being buffed. This is accomplished by providing posts on the outer ends of the bracket which can be readily inserted into a bore provided in the outer extremity of the last link forming part of the arm arrangement.

Accordingly, it is an important object of the present invention to provide an apparatus for sharpening the blades of implements which includes a blade holder that can be readily turned over for sharpening the edge in two different directions.

Another important object of the present invention is to provide an apparatus for sharpening the blades of implements such as knives and scissors wherein the angle that the blade is presented to the sharpening wheel remains the same regardless of the wear of the wheel.

Still another important object of the present invention is to provide an apparatus for sharpening the blades of implements such as scissors and knives wherein the edge of the blade can be readily moved across the face of a sharpening wheel.

Still another important object of the present invention is to provide an apparatus for sharpening the edge of a blade wherein the angle that is desired to be sharpened thereon can be readily and accurately adjusted.

The construction designed to carry out the invention will be hereinafter described, together with other features thereof.

The invention will be more readily understood from a reading of the following specification and by reference to the accompanying drawings forming a part thereof, wherein an example of the invention is shown and wherein:

DESCRIPTION OF A PREFERRED EMBODIMENT

Figure 1:
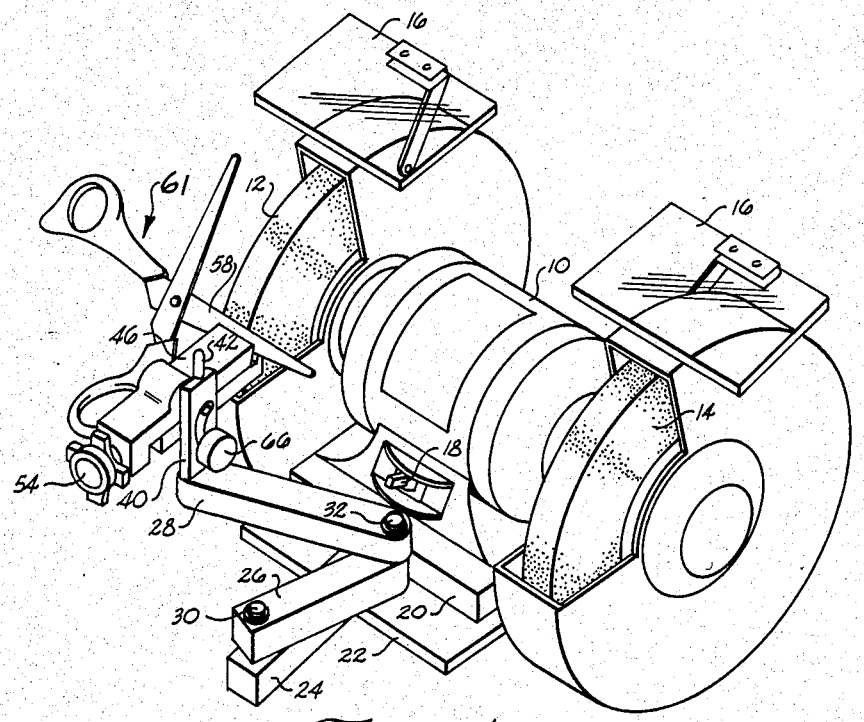
FIG. 1 is a perspective view of a blade sharpening device constructed in accordance with the present invention.

Referring in more detail to the drawings, there is illustrated a conventional sharpening device which includes a motor 10 which has a sharpening wheel 12 positioned on one side with a buffer wheel 14 carried on the other side thereof. This may be any conventional grinding or sharpening wheel equipped with the standard items such as protective shields 16 and ON/OFF switch 18. The motor 10 is supported on a base 20 that is, in turn, secured to the flat metal plate 22.

Figure 3:
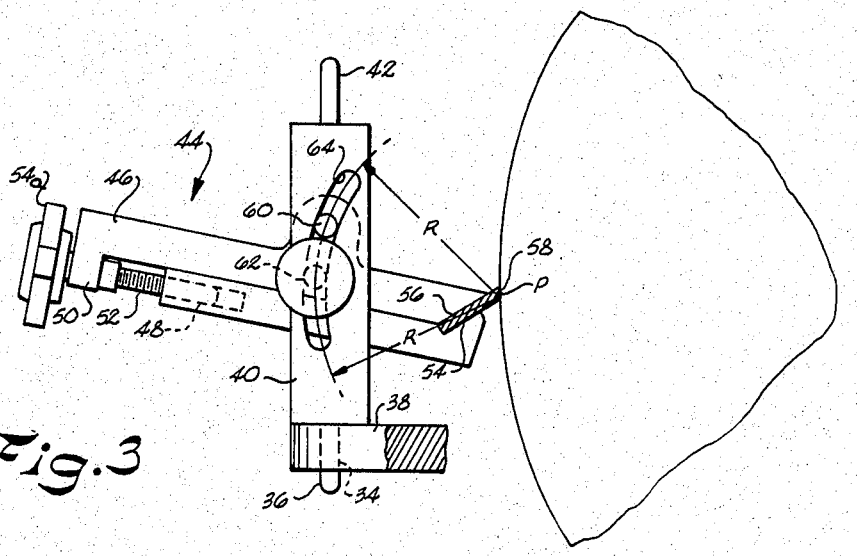
FIG. 3 is a side elevational view illustrating the manner in which the angular position of the blade holder can be changed.

Mounted on the plate 22 is a blade holder that is supported on an arm arrangement. The arm arrangement includes a plurality of links 24, 26, and 28. The lower link 24 has its inner end pivotably attached by means of a vertically extending post to the base plate 22. The outer end of the link 24 has a vertically extending post provided thereon which extends upwardly through a bushing provided in an end of link 26. The other end of the intermediate link 26 has a post 32 projecting upwardly therefrom which extends into a bushing provided on an end of the link 28. There is provided a vertically extending bore 34 in the outer extremity of the link 28 into which a pin or post 36 carried on a bracket extends. The bracket is substantially rectangular shaped and has another post 42 projecting out of the upper end thereof. A blade holder generally designated by the reference character 44 is carried by the vertically extending bracket 40. The blade holder includes a pair of elongated members 46 and 48 slidably positioned relative to each other. Elongated member 46 has a flange 50 provided on the outer end thereof. Extending through the flange 50 is a threaded bore through which a threaded bolt 52 extends to threadably engage the slidable member 48. By rotating an enlarged knob 54*a* provided on the end thereof, the slidable member 48 is moved longitudinally relative to the member 46. Adjacent the other end of the slidable member 48 is one face 54 of a clamping jaw. This face is angled as shown in FIG. 3. Directly opposite the face 54 of the clamping jaw is a face 56 forming part of the clamping jaw. The face 56 is carried on the inner end of elongated member 46.

By rotating the enlarged knob 54, the two faces 54 and 56 can be separated for receiving and holding a blade 58 to be sharpened. As shown in FIG. 1, the blade 58 forms part of a pair of scissors 61.

The holder 44 is attached to the vertical bracket by means of a pair of laterally extending posts 60 and 62 which project out of the side wall of the elongated member 46 through an arcuate groove 64 which is provided in the vertically extending bracket 40. A knob 66, as shown in FIG. 1, is threaded on the post 62 so that when such is rotated, it draws the blade holder 44 tightly up against the opposed surface of the vertically extending bracket 40 for holding such tight in a fixed position.

As seen in FIG. 3, the center of curvature of the groove 64 is approximately at the outer edge of the blade to be sharpened which is normally approximately $\frac{1}{8}''$ out beyond the holding jaws of the holder 44.

The posts 60 and 62 permit the blade holder to be rotated for changing the angle that the gripping jaws present the edge of the blade to the grinding wheel. As a result of the two posts 60 and 62 being utilized, the edge of the blade is always coplanar with and presented to the true center of the cutting wheel regardless of the angle that the holder 44 is positioned. Such is particularly advantageous since the blade that is to be sharpened is always presented at the same point on the grinding wheel and, as a result, at the same angle regardless of the wear of the wheel.

Figure 2:
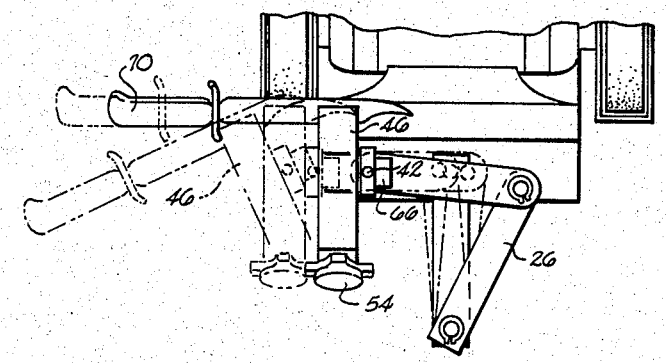
FIG. 2 is an enlarged plan view illustrating the blade holder holding the edge of a knife in different sharpening positions.

When sharpening an edge on an implement such as a knife 70 or a blade of a pair of scissors 61, first the blade is presented to the grinding wheel 12 for sharpening the blade to the desired angle that is set by rotating the holder 44 and tightening the knob 66. The holder does not tend to move as a result of the two posts 60 and 62 being utilized to position it within the vertically extending bracket 40. As shown in FIG. 2, the pivotable arms 24, 26 and 28 permit different angle surfaces and lengths to be readily presented to the grinding wheel. It is noted, however, that all of the surfaces to be sharpened are presented at the same horizontal plane relative to the grinding wheel. During the sharpening operation on wheel 12, the grinding wheel is rotated into the cutting edge of the scissors. After the initial edge has been sharpened on the blade, it is desired that the scissors be buffed on a buffing wheel being with the direction of rotation of the buffing wheel towards the cutting edge. This is readily accomplished by merely lifting the vertical bracket 40 and turning it over and inserting the post 42 back into the bore 34 carried on the end of the arm 28. The entire arm arrangement is then shifted laterally in front of the buffer wheel 14.

While a preferred embodiment of the invention has been described using specific terms, such description is for illustrative purposes only, and it is to be understood that changes and variations may be made without departing from the spirit or scope of the following claims.

What is claimed is:

1. An apparatus for holding a blade of an implement while sharpening a face of an edge of said blade thereon with a circumferential sharpening face of a rotating sharpening wheel comprising:

a blade holder supporting said blade to be sharpened;

an arm arrangement including a plurality of links supporting said blade holder on an outer extremity of said arm arrangement;

means for pivotally connecting said links together for movement in a plane substantially parallel to a sharpening plane containing both the true center of said sharpening wheel and the point at which said face of said edge of said blade touches said sharpening face of said sharpening wheel, permitting said blade holder to be moved in a straight line across said circumferential sharpening face of said sharpening wheel;

a vertically extending cylindrical bore provided in said outer extremity of said arm arrangement for receiving said blade holder;

a pair of opposed vertically extending posts, being in a plane substantially perpendicular to said sharpening plane, provided on said holder, said posts being smooth and cylindrical and corresponding in diameter to the diameter of said bore so that either post can be inserted in said bore for supporting said holder on said arm arrangement and permitting said holder to be turned over for reversing said face of said edge of said blade to the direction of rotation of said sharpening wheel while allowing said face of said edge of said blade to remain facing said circumferential sharpening face of said sharpening wheel; and said blade holder being supported by said post in said bore to swivel freely about said outer extremity of said arm arrangement in a plane substantially parallel to said sharpening plane.

2. The apparatus as set forth in claim 1 further comprising:

said holder including, (i) a vertically extending bracket;

(ii) said pair of vertically extending posts extending out of opposed ends of said bracket;

(iii) an arcuate groove provided in said bracket;

(iv) a clamping jaw mechanism supporting said blade, and (v) a pair of posts extending from said clamping jaw into said groove securing said clamping jaw to said vertically extending bracket.

3. The apparatus as set forth in claim 2 further comprising:

a locking means for adjustably fixing said clamping jaw mechanism relative to said vertically extending bracket by sliding said pair of posts in said arcuate groove so as to change the angle that said blade is held relative to said sharpening wheel.

4. An apparatus for holding a blade of an implement while sharpening a face of an edge of said blade thereon with a circumferential sharpening face of a rotating sharpening wheel comprising:

a blade holder;

an arm arrangement including a plurality of links supporting said blade holder on an outer extremity of said arm arrangement;

means pivotably connecting said links together for pivoting in planes substantially parallel to a sharpening plane containing both the true center of said sharpening wheel and the line of contact at which said face of said edge of said blade touches said sharpening face of said sharpening wheel, permitting said blade holder to be moved in a straight line across said circumferential sharpening face of said sharpening wheel;

said blade holder comprising:

(i) a support bracket;

(ii) an arcuate groove provided in said support bracket;

(iii) a clamping jaw mechanism extending outwardly from said support bracket positioning said blade to be sharpened adjacent said sharpening wheel; and (iv) post means extending from said clamping jaw mechanism into said groove for adjustably positioning said clamping jaw relative to said sharpening wheel, said post means including a pair of spaced posts extending into said arcuate groove; and (v) locking means for fixing the position of said clamping jaw mechanism for holding said blade at a predetermined angle relative to said circumferential face of said sharpening wheel.

5. The apparatus as set forth in claim 4 further comprising:

said arcuate groove having a center of radius which is at approximately the edge of said blade held in said clamping jaw for being sharpened.

6. The apparatus as set forth in claim 4 further comprising:

attachment means carried on opposed ends of said support bracket so that said support bracket can be attached to the outer end of said outer extremity of said arm by either end;

whereby said blade to be sharpened can be presented to said sharpening wheel with the wheel rotating towards the edge of said blade or away from the edge of said blade.

7. The apparatus as set forth in claim 4 further comprising:

means carried by said blade holder for holding said face of said edge of said blade at a predetermined angle relative to said circumferential sharpening face of said sharpening wheel; and means carried by said blade holder for permitting said blade holder to be turned over for reversing said face of said edge of said blade to the direction of rotation of said sharpening wheel while allowing the same said face of said edge of said blade to remain at the same said predetermined angle relative to said circumferential sharpening face of said sharpening wheel.

8. The apparatus as set forth in claim 5, wherein said center of radius is in substantially the same horizontal plane as the true center of the sharpening wheel, so that as the diameter of said sharpening wheel decreases with wear, the angle of said edge of said blade being sharpened remains the same.

9. An apparatus for sharpening a blade of an implement comprising:

a blade holder supporting said blade to be sharpened;

a first rotating sharpening wheel means for sharpening a face of said blade having a sharpening surface;

an arm arrangement including a plurality of links supporting said blade holder on an outer extremity of said arm arrangement;

means for pivotally connecting said links together permitting said blade holder to be moved in a straight line across said sharpening surface of said sharpening wheel means;

means for supporting said face of said edge of said blade being sharpened on said blade holder at a predetermined angle with respect to said sharpening surface so that said face of said blade is contacting said sharpening surface of said sharpening wheel means moving in a first direction relative to said face of said blade;

a second rotating sharpening wheel means rotating in the same direction as said first sharpening wheel means; and means for detachably mounting said blade holder on said arm arrangement so that said blade holder may be removed from said arm arrangement, rotated 180 degrees to an upside-down position and remounted on said arm arrangement so that the same said face of said blade being sharpened is contacting said second sharpening wheel means at said predetermined angle.

* * * * *